US007637185B2

(12) United States Patent
Montgomery et al.

(10) Patent No.: US 7,637,185 B2
(45) Date of Patent: Dec. 29, 2009

(54) PLIER TOOL FOR CLOSING CLAM-SHELL TYPE ELECTRICAL CONNECTORS

(75) Inventors: David E. Montgomery, Montoursville, PA (US); Robert A. Libby, Williamsport, PA (US); Kyle Mason, Williamsport, PA (US)

(73) Assignee: Aslan Industries Corporation, Montoursville, PA (US)

( * ) Notice: Subject to any disclaimer, the term of this patent is extended or adjusted under 35 U.S.C. 154(b) by 0 days.

(21) Appl. No.: 12/082,617

(22) Filed: Apr. 11, 2008

(65) Prior Publication Data

US 2009/0255382 A1 Oct. 15, 2009

(51) Int. Cl.
*B25B 7/02* (2006.01)

(52) U.S. Cl. ..... 81/426; 81/424

(58) Field of Classification Search ..... 81/418–426.5, 81/186, 185.1

See application file for complete search history.

(56) References Cited

U.S. PATENT DOCUMENTS 2,584,353 A * 2/1952 Keiser ..... 81/426
4,353,240 A * 10/1982 Undin et al. ..... 81/418
5,485,770 A * 1/1996 Popelak ..... 81/423
6,401,578 B1 * 6/2002 Domenge ..... 81/424
7,024,911 B2 * 4/2006 Delhumeau et al. ..... 81/367

* cited by examiner

*Primary Examiner*—Hadi Shakeri
(74) *Attorney, Agent, or Firm*—Thomas R. Shaffer

(57) ABSTRACT

A plier tool for closing clam shell type electrical connectors onto electrical wires includes a pair of handles, an upper jaw and a lower jaw. The upper jaw and the lower jaw are movable between an open position and a closed position. The jaws move relatively closer together during a closing operation upon squeezing together of the handles. An upper die member having a pivotal connection point is pivotally attached to the upper jaw for pivotal movement during the closing operation. The upper die member also has a generally planar upper contact surface. The upper contact surface is adapted to continuously contact and slide upon a lid portion of a clam shell type electrical connector during the closing operation. A lower die member is rigidly attached to said lower jaw and has a lower contact surface. The lower contact surface has a cavity therein sized to receive and retain a base portion of clam shell type electrical connector during the closing operation.

14 Claims, 8 Drawing Sheets

PLIER TOOL FOR CLOSING CLAM-SHELL TYPE ELECTRICAL CONNECTORS

BACKGROUND OF THE INVENTION

1. Field of the Invention

The present invention relates to a plier tool for closing clam shell type electrical connectors. More specifically, it relates to such a plier tool utilizing a pivotally connected upper die member and a fixed lower die member.

2. Description of the Prior Art

The use of a broad range and type of plier type tools is extremely well known in the art. Mechanics, craftsmen, orthodontists and others routinely use a variety of specialized pliers for accomplishing particular tasks. A few of the many known plier type tools and crimping tools are disclosed in the following U.S. Patents: Allen, U.S. Pat. No. 3,704,620; Filia, U.S. Pat. No. 3,710,611; Filia, U.S. Pat. No. 3,673,848; Liu, U.S. Pat. No. 5,277,051; Undin et al., U.S. Pat. No. 4,637,242; Steiner, U.S. Pat. D322,544; D336,025; D532,672; and D534,412.

Examples of some other known designs for various plier-like crimp tools are found in a catalog entitled "Sargent Quality Tools-Professional Tools" as disclosed in a catalog for Rostra Tool Company of P.O. Box 5, 30 East Industrial Road, Branford, Conn. 06405.

Krampe, U.S. Pat. No. 5,611,138 discloses a complex plier-shaped tool which is utilized for twisting the partly striped end of a multiple-strand core of an insulated conductor.

Gardner, U.S. Pat. No. 4,905,350 discloses a plier-type clam opener. This device utilizes a wedge section 27 which forces the clam shells apart. The device includes a seat element 20 which is pivotally connected by a pin 21 to the outer end of the first jaw element 10. As can be best seen in FIGS. 7 and 8, this pivotal motion allows the same plier tool to be utilized for small clams (FIG. 7) and large clams (FIG. 8) simply by slipping the element 20 to the desired initial position before use. The Gardner device does not teach or suggest the use of any pivotal motion of a jaw or die member during a closing operation of the pliers.

In recent years, the provision of hinged or clam shell type electrical connectors has been proposed as a quick and efficient way to provide a connector onto an electrical cable. Examples of such devices can be seen in DeRoss et al., U.S. Pat. No. 6,074,238 (see in particular FIGS. 2, 3, and 4); Libby II et al., U.S. Pat. No. 7,281,941 and in Libby et al., U.S. Pat. No. 7,144,269. In order for clam-shell type electrical connectors to make effective and reliable electrical connections with the conductors in the cable, it is necessary that sufficient force be applied to the lid when closing the lid onto the body of the connector. While it is certainly possible that any of a variety of known plier devices could be utilized to apply sufficient force, unless the force is carefully controlled and uniformly directed onto the lid of the clam shell connector, it is possible, and in many case likely, that the connector will be broken or damaged by the pliers.

There remains, therefore, a need for a plier tool designed specifically for the safe and reliable closing of hinged or clam shell type electrical connectors onto electrical cables. The plier tool of the present invention is specifically designed to close a hinged or clam shell type connector of the type manufactured by Aslan Industries and marketed under the trademarks Q-CEB™ and SNAP PHASE™ but, as will be obvious to one of ordinary skill in the art, such a plier tool may be modified to effectively close any clam shell type electrical connector. As used in this patent application the term "clam shell connector" is broadly defined and is intended to include any electrical connector having a base portion into which an electric cable may be inserted and having lid portion pivotally mounted to said base portion whereby said lid portion may be moved relative to the base portion between an open and a closed position.

SUMMARY OF THE INVENTION

The present invention, in its simplest form, provides a plier tool for closing clam shell type electrical connectors onto electrical wires comprising: a pair of handles; an upper jaw; a lower jaw, said upper jaw and said lower jaw movable between an open position and a closed position and being movable relatively closer together during a closing operation upon squeezing together of said handles; an upper die member, said upper die member having a pivotal connection point and being pivotally attached to said upper jaw for pivotal movement during said closing operation, said upper die member also having a generally planar upper contact surface, said upper contact surface adapted to continuously contact and slide upon a lid portion of a clam shell type electrical connector during said closing operation; and a lower die member, said lower die member rigidly attached to said lower jaw and having a lower contact surface, said lower contact surface having a cavity therein sized to receive and retain a base portion of clam shell type electrical connector during said closing operation.

Preferably, said upper contact surface and said lower contact surface are parallel and are spaced apart a distance less that a thickness of a closed clam shell type electrical connector when said jaws are in a closed position.

Preferably, said upper contact surface and said lower contact surface are positioned at an angle of between 40° and 60° when said jaws are in an open position, with an angle of approximately 51° being preferred.

Preferably, said upper contact surface has portions thereof removed to reduce the contact area between said upper contact surface and said lid to allow for a sliding movement with less friction. Preferably, a series of parallel grooves are removed from said upper contact surface.

Preferably, said upper die member has an upper flange on a connection side of said die opposite said upper contact surface. Preferably, said pivotal connection point is a hole provided in a middle portion of said upper flange. Preferably, said upper jaw has an upper jaw connection hole therein near a terminal end located at said pivotal connection point.

Preferably, only a middle and rear portion of said upper contact surface make initial contact with said lid during a closing operation when said jaws are in an open position and a front, middle and rear portion of said upper contact surface make contact with said lid when said jaws are in a closed position.

Preferably, said lower contact surface has an outer stop ledge to prevent outward longitudinal motion of said base portion of a clam shell type electrical connector during a closing operation and said lower contact surface has an inner ledge to prevent inward longitudinal motion of said base portion of a clam shell type electrical connector during a closing operation. Preferably, said lower contact surface has at least one key portion adapted to receive a particular portion and to allow insertion of a clam shell type electrical connector in only a proper position and orientation. The lower contact surface also preferably has a pair of side ledges to prevent transverse motion of said base portion of a clam shell type electrical connector during a closing operation.

Preferably, said lower jaw member has a lower flange on a connection side of said die opposite said lower contact surface and said lower flange has a hole therein utilized to rigidly attach said lower die to said lower jaw. Preferably, said lower jaw has a lower jaw connection hole therein located near a middle portion of said lower jaw utilized to rigidly attach said lower die to said lower jaw.

In an alternative embodiment of the invention, said lower die member is integrally formed on said lower jaw member.

DETAILED DESCRIPTION OF THE PREFERRED EMBODIMENTS

Figure 1:
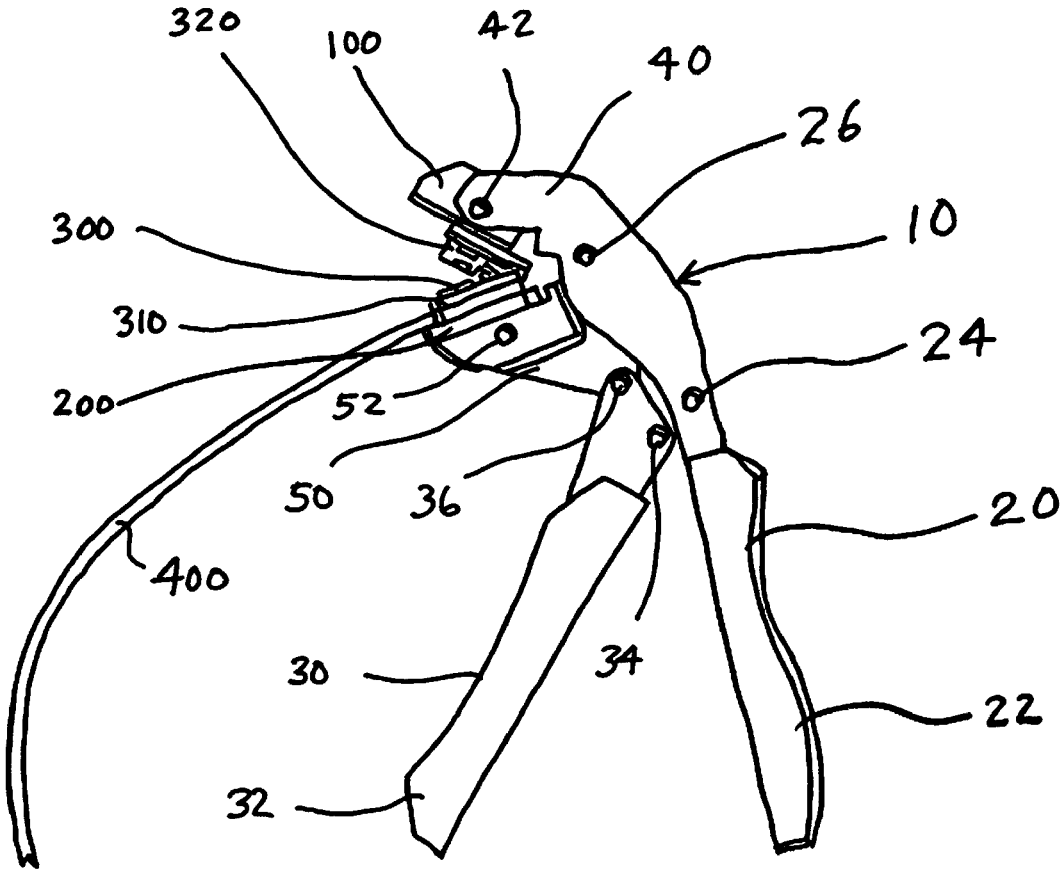
FIG. 1 is a side view of the plier tool of the present invention with a clam-shell type connector placed between an upper and lower die member with the jaws in an open position.

Referring to FIGS. 1-7, the plier tool 10 of the present invention includes a top handle 20 which has a top handle end 22 and a top jaw end 40. The top handle 20 also includes a top handle connection point 24, a top handle jaw connection point 26 and a top handle die connection point 42.

The plier tool 10 also includes a bottom handle 30 which includes a bottom handle end 32, a bottom handle connection point 34 and a bottom handle jaw connection point 36. The bottom jaw 50 is pivotally connected to the bottom handle 30 at bottom handle connection point 36. The top handle 20 is connected to the bottom handle 30 at the top handle connection point 24. The top handle 20 is connected to the bottom jaw 50 at the top handle jaw connection point 26. The jaw 50 also includes a bottom handle die connection point 52.

The top die 100 is pivotally connected to the top jaw end 40 of top handle 20 by means of top handle die connection point 42. A bottom die 200 is rigidly attached to the bottom jaw 50 of the bottom handle 30 by means of a rigid connection at bottom handle die connection point 52.

Figure 2:
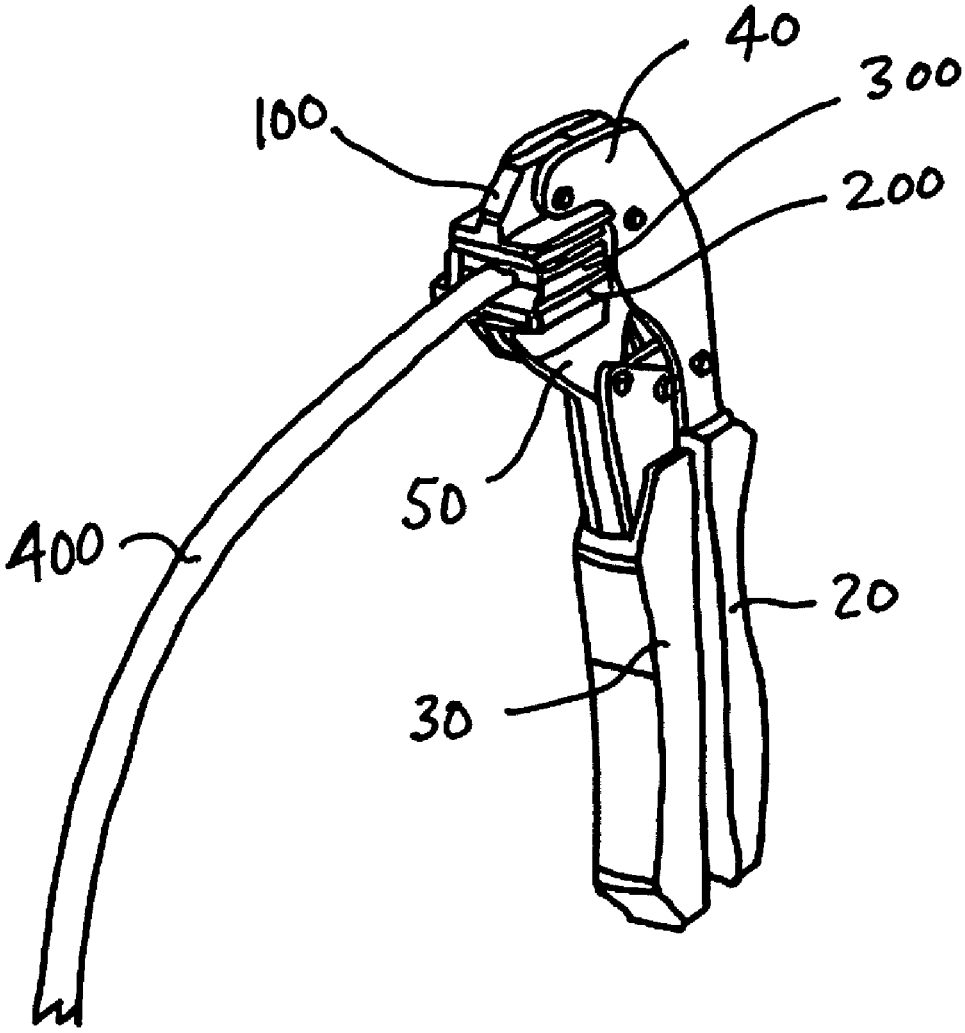
FIG. 2 is a perspective view of the plier tool of FIG. 1 with the jaws in a closed position.

As shown in FIGS. 1 and 2, a clam shell type connector (of the type described in Libby II et al., U.S. Pat. No. 7,281,941 and in Libby et al., U.S. Pat. No. 7,144,269) is shown at 300. Said clam shell connector 300 had a lid portion 320 and a base portion 310. During a closing operation, the lid portion 320 slides on the upper die member 100 while the base portion 310 is rigidly secured within the bottom die 200.

Figure 3:
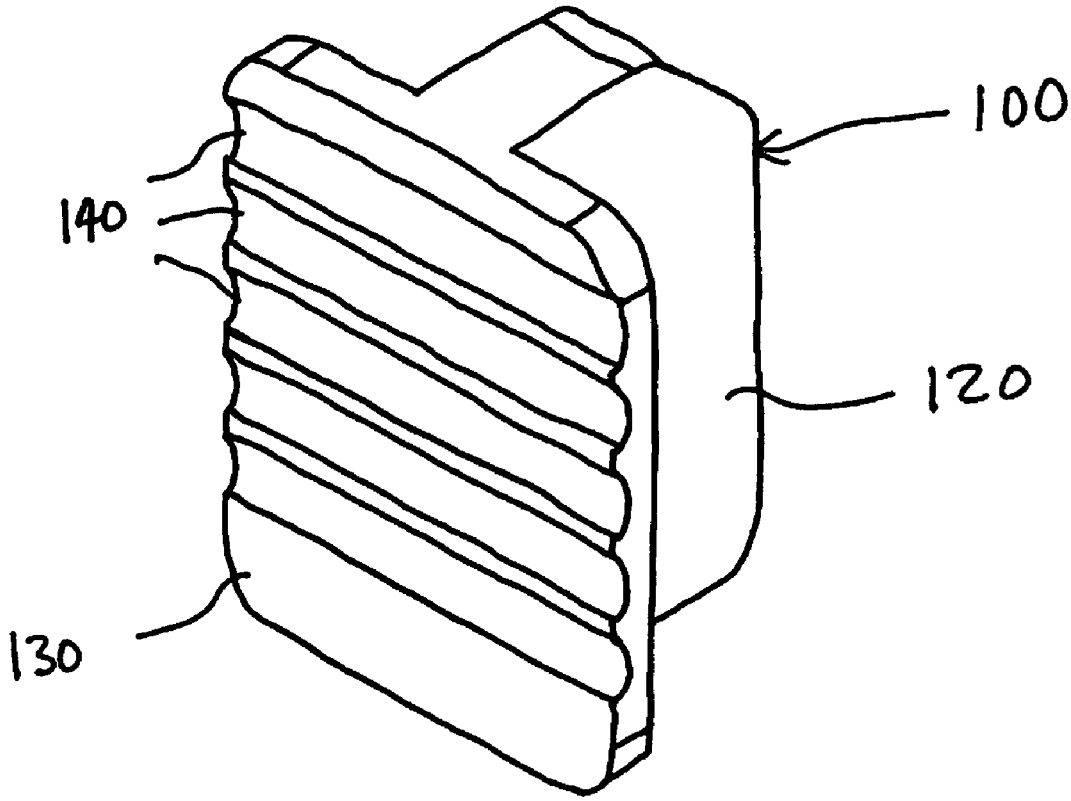
FIG. 3 is a perspective view of an upper die member according to the present invention.
Figure 4:
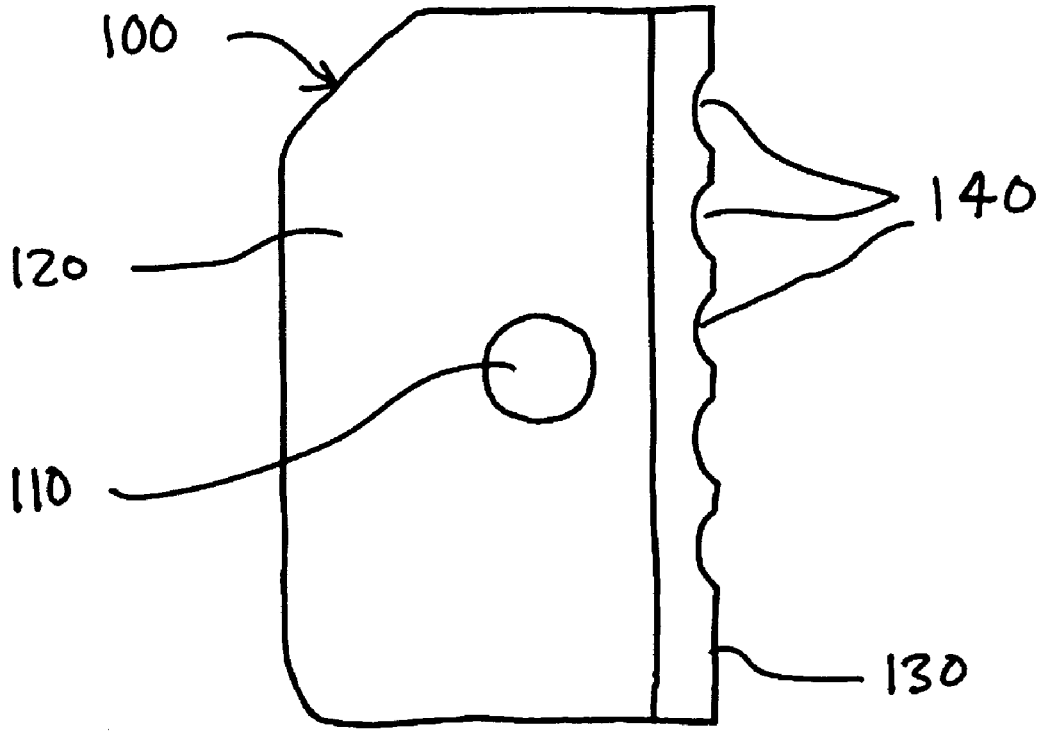
FIG. 4 is a side elevational view of an upper die member according to the present invention.

Referring specifically to FIGS. 3 and 4, the upper die member 100 is illustrated. The upper die member 100 has planar upper contact surface 130. As shown, the upper contact surface has portions 140 thereof removed to reduce the contact area between the upper contact surface 130 and said lid 320 to allow for a sliding movement with less friction. As shown, the removed portions are in the form a series of parallel grooves 140.

The upper die member 100 has an upper flange 120 on a connection side on upper die member 100 which is located opposite the upper contact surface 130. A pivotal connection point in the form of a hole 110 is provided in the upper flange 120 to allow for a pivotal connection of the upper die member 100 to the top handle die connection point 42 of the top handle 20. As shown, the hole 110 is provided in a middle portion of the upper flange 100. The pivotal connection point which occurs at the location of hole 110 is made at the top handle die connection point 42 which is located near a terminal end of the top jaw end 40.

Figure 5:
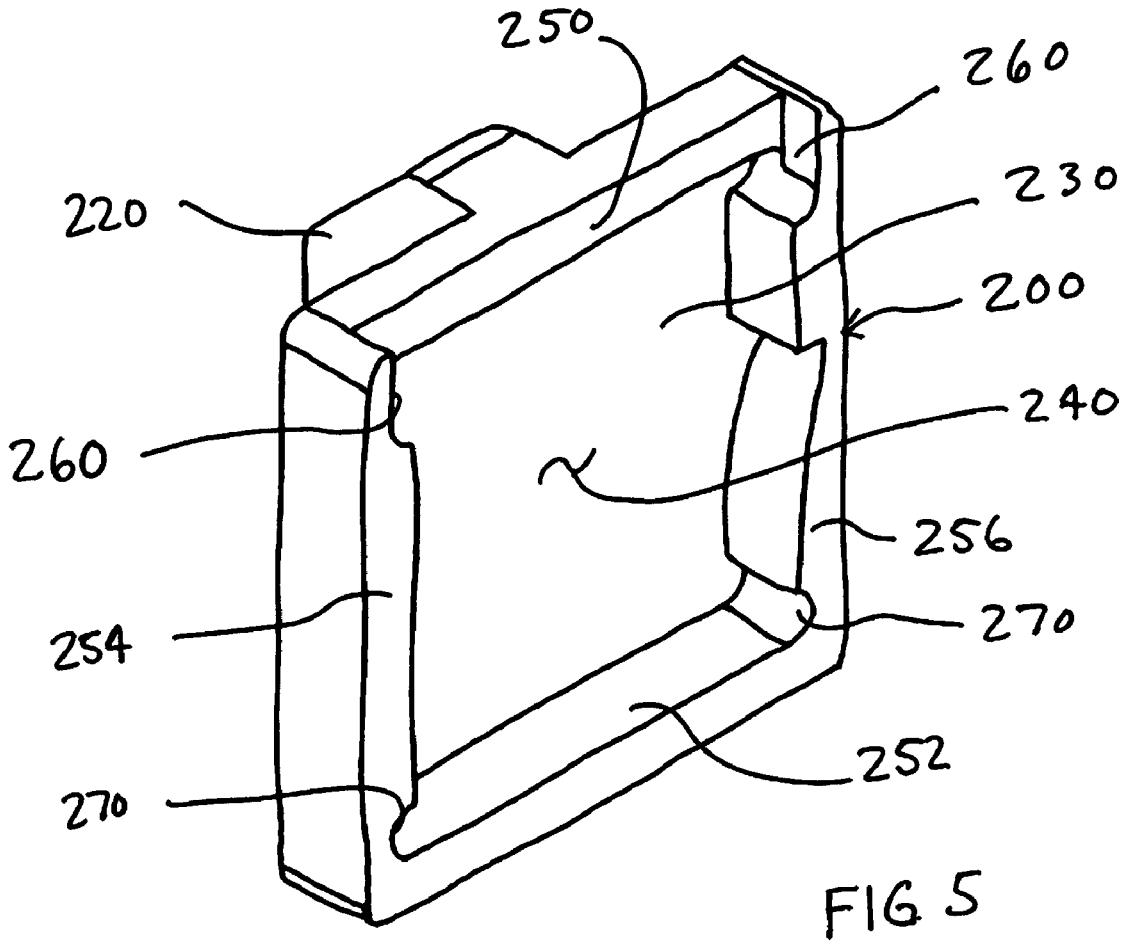
FIG. 5 is a perspective view of a lower die member according to the present invention.
Figure 6:
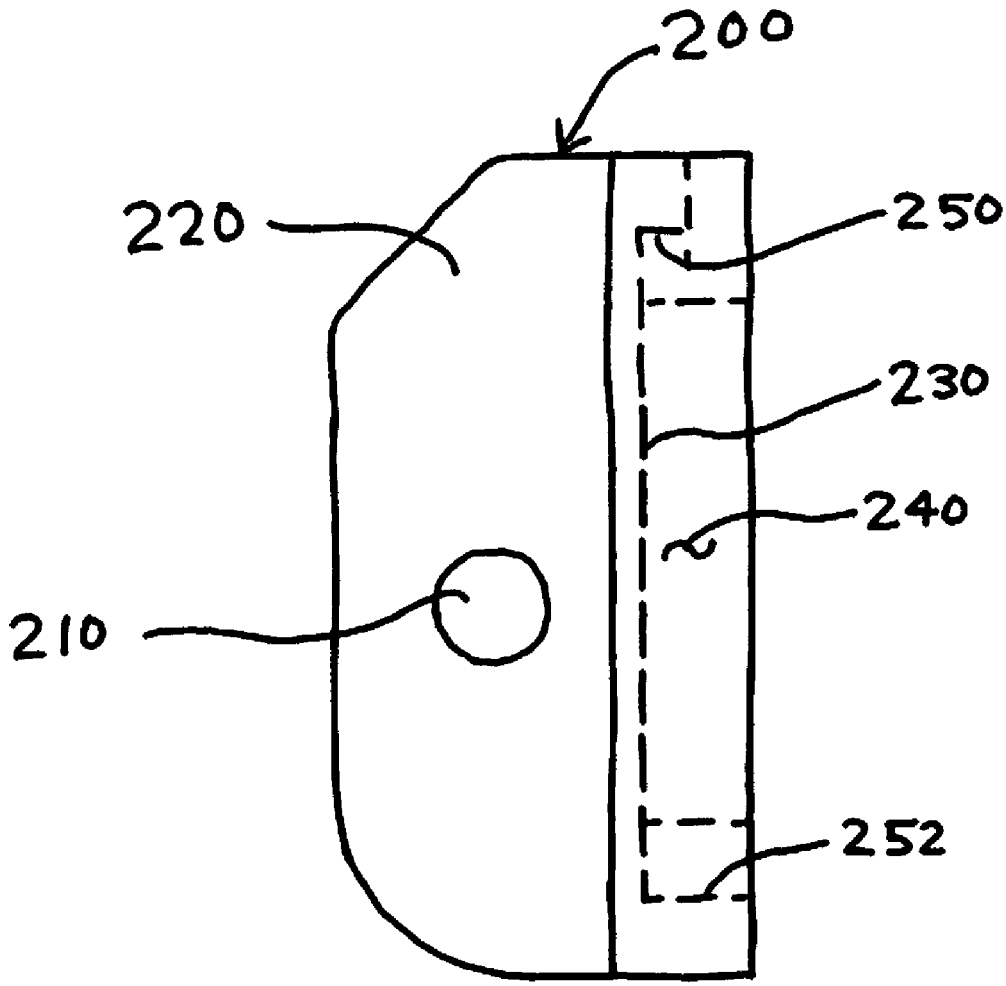
FIG. 6 is a side elevational view of a lower jaw member according to the present invention.
Figure 7:
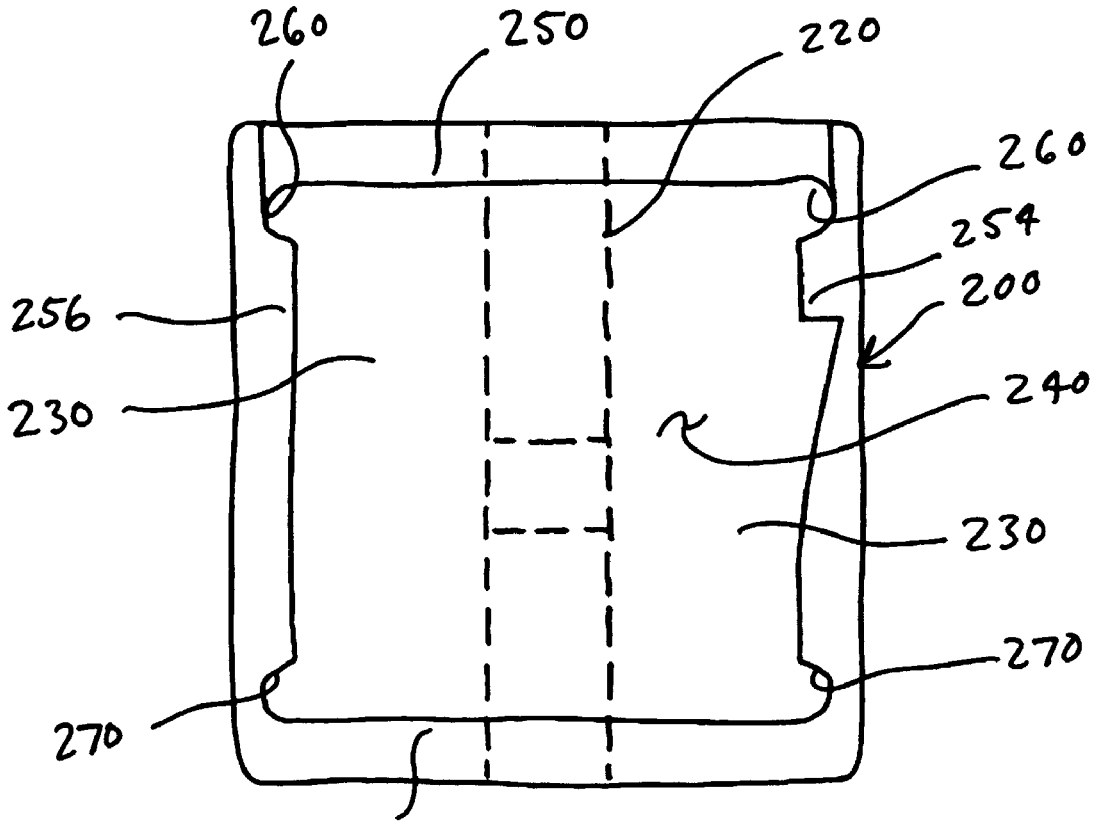
FIG. 7 is a top plan view of a lower jaw member according to the present invention.

Referring to FIGS. 5, 6 and 7, the lower die member 200 shown which has rigid connection point 210 in the form of a hole provided on a lower flange 220 on the opposite side of a lower contact surface 230. The lower die member 200 is formed to have a cavity 240 therein sized to receive the base portion 310 of a clam shell electrical connector 300. The lower contact surface 230 has an outer stop ledge 250 to prevent outward longitudinal movement of the electrical connector 300 when placed in the cavity 240. Further, an inner ledge 252 prevents inward movement and side ledges 254 and 256 prevent transverse movement of the electrical connector 300. A pair of outer key members 260 and a pair of inner key members 270 are provided which are designed to mate with corresponding key points (not shown) in base portion 310 of an electrical connector 300 in a manner that will only allow the base 310 to fit into the cavity in the proper orientation.

In operation, when the upper jaw member 40 and the lower jaw member 50 are in an open position as shown in FIG. 1, the upper contact surface 130 is at an approximate angle of 51 degrees relative to the lower contact surface 230. Preferably, this angle in the open position is between 50 and 60 degrees. As shown in FIG. 1. A front and middle portion of the lid 320 makes contact with the upper die member 100 when in the open position of FIG. 1. The rear portion of lid 320 (located where the hinged connection with the base 310 is located) is not in physical contact with the upper die member 100 in the open position. When the plier handle ends 22 and 32 are squeezed together, the upper contact surface 130 slides on the top of the lid 320 while the base 310 is held firmly in position. When in a fully closed position as shown in FIG. 2, the entire top and bottom surfaces of the electrical connector 300 are in contact with the upper die 100 and lower die 200, respectively.

Figure 8:
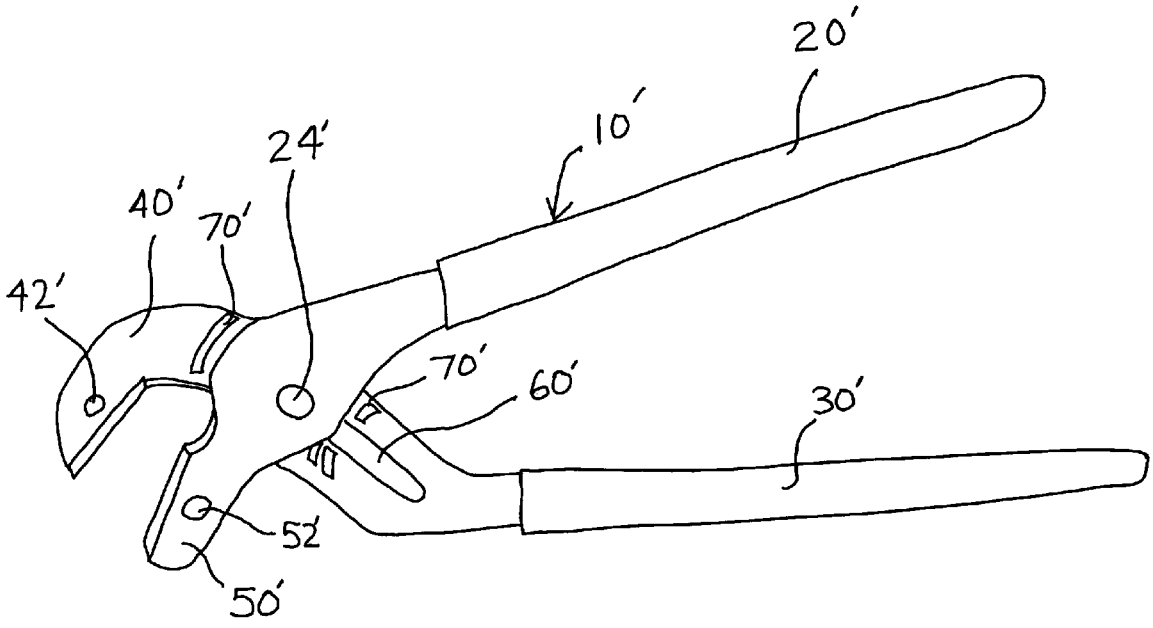
FIG. 8 is a side view of an alternative type of pliers to which upper and lower die members can be attached according to the present invention.

In FIGS. 1-7, the plier handles and jaws are shown to be a commercially available product in the form of a "4200 frame assembly" as is available from Rostra Tool Company of P.O. Box 5, 30 East Industrial Road, Branford, Conn. 06405. It will be understood by those skilled in the art that virtually any type of plier could be adapted for use with the present invention. By means of one example, FIG. 8 shows an alternative plier. The plier 10' has a top handle 20' and a lower handle 30'. The handles are pivotally mounted to one another at 24'. A slot 60' in lower handle 30' in combination with a series of ridges 70' allow for the top handle and bottom handle to be adjusted for different height objects or connectors. The upper jaw 40' has a pivotal connection point 42' thereon which would be connected to connection point 110 of an upper die 100. The lower jaw 50 has a connection point 52' which would be rigidly secured to a lower die 200 at connection point 210. Various other plier types could be utilized.

It is to be understood that while certain forms of the present invention have been illustrated and described herein, the present invention is not to be limited to the specific forms or arrangements of parts described and shown.

We claim:

1. In combination, a clam shell type electrical connector and a pliers tool for closing the clam shell type electrical connector onto electrical wires comprising:

said clam shell type electrical connector having a base portion and a pivotally mounted lid portion wherein closing the lid onto the base makes an effective and reliable electrical connection with conductors in an electrical cable; and said pliers tool comprising:

a pair of handles;

an upper jaw;

a lower jaw, said upper jaw and said lower jaw movable between an open position and a closed position and being movable relatively closer together during a closing operation upon squeezing together of said handles;

an upper die member, said upper die member having a pivotal connection point and being pivotally attached to said upper jaw for pivotal movement during said closing operation, said upper die member also having a generally planar upper contact surface, said upper contact surface adapted to continuously contact and slide upon said lid portion of the clam shell type electrical connector during said closing operation;

a lower die member, said lower die member rigidly attached to said lower jaw and having a lower contact surface, said lower contact surface having a cavity therein sized to receive and retain said base portion of the clam shell type electrical connector during said closing operation, wherein said lower contact surface has an outer stop ledge and an inner ledge to prevent outward and inward longitudinal motion of said base portion, respectively, and said lower contact surface also having a pair of side ledges to prevent transverse motion of said base portion and further includes outer and inner key portions adapted to receive particular portions of said base portion and to allow insertion of the clam shell type electrical connector in only a proper position and orientation; and wherein, during said closing operation the lid portion slides on said upper die member while the base portion is rigidly secured within said bottom die.

2. The combination according to claim 1 wherein said upper contact surface and said lower contact surface are parallel and are spaced apart a distance less that the a thickness of said closed clam shell type electrical connector when said jaws are in a closed position.

3. The combination according to claim 1 wherein said upper contact surface and said lower contact surface are positioned at an angle of between 40° and 60° when said jaws are in an open position.

4. The combination according to claim 1 wherein said upper contact surface and said lower contact surface are positioned at an angle of approximately 51° when said jaws are in an open position.

5. The combination according to claim 1 wherein said upper contact surface has portions thereof removed to reduce the contact area between said upper contact surface and said lid to allow for a sliding movement with less friction.

6. The combination according to claim 5 wherein a series of parallel grooves are removed from said upper contact surface.

7. The combination tool according to claim 1 wherein said upper die member has an upper flange on a connection side of said die opposite said upper contact surface.

8. The combination according to claim 7 wherein said pivotal connection point is a hole provided in a middle portion of said upper flange.

9. The combination according to claim 1 said upper jaw has an upper jaw connection hole therein near a terminal end located at said pivotal connection point.

10. The combination according to claim 1 wherein only a middle and rear portion of said upper contact surface make initial contact with said lid during a closing operation when said jaws are in an open position and a front, middle and rear portion of said upper contact surface make contact with said lid when said jaws are in a closed position.

11. The combination according to claim 1 wherein said lower jaw die member has a lower flange on a connection side of said lower die member opposite said lower contact surface.

12. The combination according to claim 11 wherein said lower flange has a hole therein utilized to rigidly attach said lower die to said lower jaw.

13. The combination according to claim 1 said lower jaw has an lower jaw connection hole therein located near a middle portion of said lower jaw utilized to rigidly attach said lower die to said lower jaw.

14. The combination according to claim 1 said lower die member is integrally formed on said lower jaw member.

* * * * *